United States Patent [19]

Howell, Jr.

[11] 4,068,774

[45] Jan. 17, 1978

[54] MATERIAL HANDLING IMPLEMENT

[76] Inventor: Silas E. Howell, Jr., Rte. 1, Garland, N.C. 28441

[21] Appl. No.: 740,058

[22] Filed: Nov. 8, 1976

[51] Int. Cl.[2] ..... E02F 3/82

[52] U.S. Cl. ..... 214/766; 214/779; 214/780

[58] Field of Search ..... 214/140, 766, 779, 780

[56] References Cited

U.S. PATENT DOCUMENTS

| | | | |
|---|---|---|---|
| 2,319,921 | 5/1943 | Dooley et al. | 214/779 |
| 2,469,615 | 5/1949 | Templeton | 214/780 |
| 2,526,954 | 10/1950 | Kucera | 214/780 |
| 2,993,608 | 7/1961 | Womble | 214/780 |
| 3,362,554 | 1/1968 | Fortier | 214/766 |

FOREIGN PATENT DOCUMENTS

| | | | |
|---|---|---|---|
| 262,889 | 6/1968 | Austria | 214/780 |
| 1,200,743 | 9/1965 | Germany | 214/780 |

OTHER PUBLICATIONS

Dearborn Rear Mounted Loader (Model 19–29) Assembly and Operating Instructions, Dearborn Motors Corp., Copyrighted 1951.

*Primary Examiner*—L. J. Paperner
*Attorney, Agent, or Firm*—Mills & Coats

[57] ABSTRACT

The present invention relates to a material handling implement adapted to be connected to and powered by the three-point hitch of a conventional farm tractor. The material handling implement comprises a main frame structure that attaches to the three-point hitch of said farm tractor and extends generally rearwardly therefrom. A pivotably mounted scoop or shovel assembly is disposed about the rearmost portion of said main frame structure and includes a pivotably mounted counterbalanced scoop or shovel whose digging angle and dumping operation may be controlled from the tractor's operator station. The particular counterbalancing of the scoop or shovel causes the scoop or shovel to automatically return to a digging position after dumping. For dumping the shovel or scoop, a manually actuated dumping control mechanism is associated with said material handling implement and disposed such that the same may be actuated from the tractor's operator station. In addition the material handling implement is provided with another manually actuated control mechanism for adjusting and varying the digging angle of the scoop or shovel.

3 Claims, 4 Drawing Figures

MATERIAL HANDLING IMPLEMENT

The present invention relates to material handling devices, and more particularly to a tractor mounted material handling implement adapted to be connected to and powered by a tractor's three-point hitch assembly.

BACKGROUND OF THE INVENTION

Various devices over the years have been known or used in the material handling field. There is large machinery used in the heavy construction or mining industry such as cranes and pans which are not only large but also costly and hard to maintain. Intermediate size material handling equipment is also in wide use. The front end loader is a principal example of this, but it is also more costly and somewhat larger than the small jobber really needs or can justify.

A device that is relatively inexpensive, simple in operation, and relatively small in size is definitely needed to perform light duty jobs that are typically performed on small farms and other situations where light to medium duty material handling jobs exist. A desirable feature of such a material handling device would be the provision of means for allowing it to be connected to and be powered by a conventional farm tractor which is usually found on the farm and is readily accessible to individuals who might use such a material handling device in other light duty operations.

This type of light duty material handling implement would provide the user with a very effective and efficient material handling system at a minimum of cost. The utility and usefulness of such a material handling implement would be substantial. For example, such could be used in and around small farms to clean and remove manure from stables and chicken houses, to fill gullies with dirt, and to transport and handle other bulk materials. Also, this type of material handling implement could be used in other light duty digging jobs such as yard leveling and even foundation digging.

SUMMARY OF THE INVENTION

The present invention presents a relatively inexpensive light duty material handling implement in the form of a shovel type attachment for a farm tractor or the like that is particularly suitable for small farms and other light duty material handling jobs. The material handling implement of the present invention is powered by a tractor and adapted to perform light duty material handling jobs such as: (1) removal of various materials such as dirt, manure, etc., (2) support of removed material during relocation, and (3) dumping of said material at desired times and locations.

More particularly, the material handling implement of the present invention comprises a main frame structure adapted to be connected to the three-point hitch of a farm tractor wherein said main frame structure extends generally rearwardly therefrom. Disposed about the rearmost end of the main frame structure is a pivotably attached shovel assembly wherein said shovel assembly includes a pivotably mounted scoop or shovel that is utilized for the removal of various types of material and supporting such material during the relocation process. Furthermore said scoop or shovel incorporates a particular counterbalancing feature whereupon after completion of a dumping operation, the counterbalancing feature causes the scoop or shovel to automatically return to a digging position.

In addition, said material handling implement includes a manually actuated dumping mechanism operatively connected to said scoop or shovel wherein the scoop or shovel is allowed to dump the material therein at a selected dumping site. The material handling implement of the present invention utilizes, in addition to the preceding feature, a manually actuated digging angle or angle of penetration adjustment capability wherein an adjustment mechanism is operatively connected to the shovel assembly and operative to vary or adjust the angle of the scoop or shovel relative to the main frame structure of the implement. The manually actuated controls for both the dumping mechanism and the angle adjustment mechanism are disposed about the frontmost end of the material handling device at a position that is adjacent to the operator's station.

It is, therefore, an object of the present invention to provide a light duty material handling implement that is relatively simple, inexpensive and compatible with a conventional farm tractor.

Another object of the present invention is to provide a light duty material handling implement that can effectively perform material handling operations in three phases — digging, transporting and dumping.

A further object of the present invention is to provide a material handling implement that includes a simple and easy to operate manually controlled dump mechanism.

In particular, with respect to the immediately abovementioned object, a further object is to provide a material handling implement having a counterbalanced shovel or scoop that upon manual dump actuation automatically dumps by moving to a dumping position, after which the same returns automatically from the dumping position to a digging position in response to the emptying of the scoop or shovel.

Still a further object of the present invention is to provide a material handling implement having means for manually varying the angle of the scoop or shovel penetration, thus allowing the material handling implement to work efficiently in various conditions.

Another object of the present invention is to provide a material handling implement that can be completely controlled from the operator's station by the tractor operator.

Another object of the present invention resides in the provision of a material handling implement having means incorporated therein for adjusting the downward reach of the implement such that the same may be compatible with various size tractors.

Other objects and advantages of the present invention will become apparent from a study of the following description and the accompanying drawings which are merely illustrative of the present invention.

DESCRIPTION OF THE PREFERRED EMBODIMENT

Figure 1:
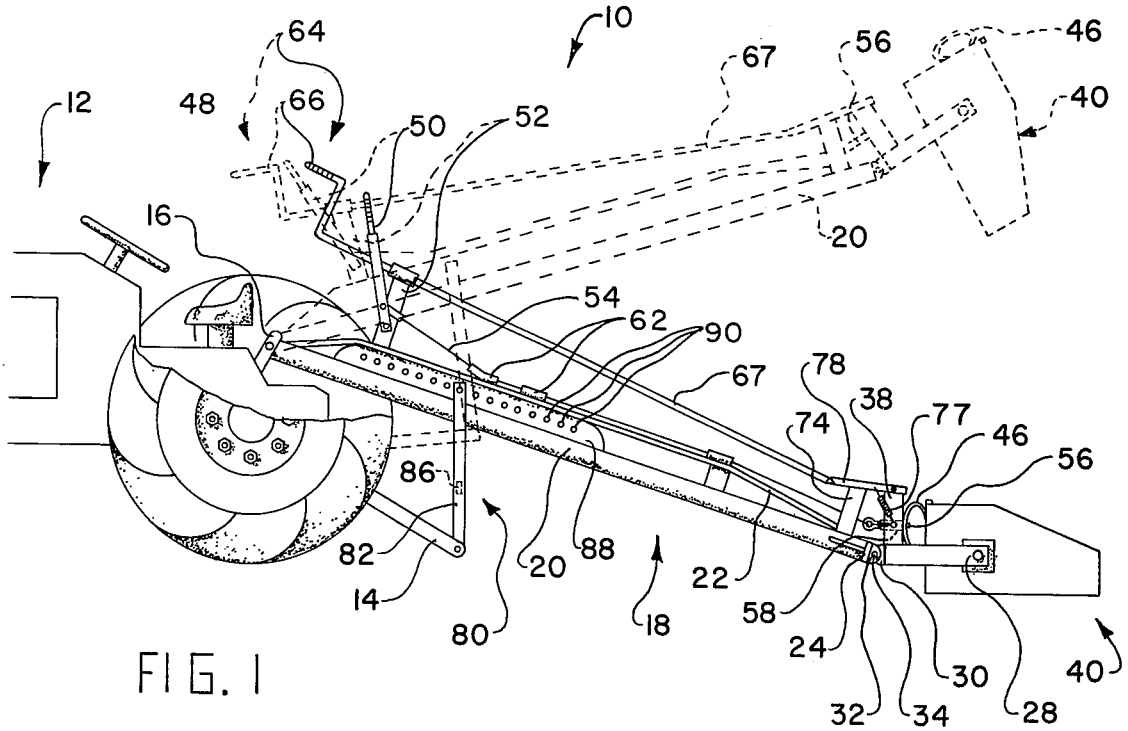
FIG. 1 is a side elevational view of the material handling implement of the present invention with the implement shown in the form of an attachment connected to the three-point hitch of a conventional farm tractor and wherein in full lines the shovel or scoop thereof is in a generally material engaging or digging position while the dumping operation is illustrated in dotted lines.
Figure 2:
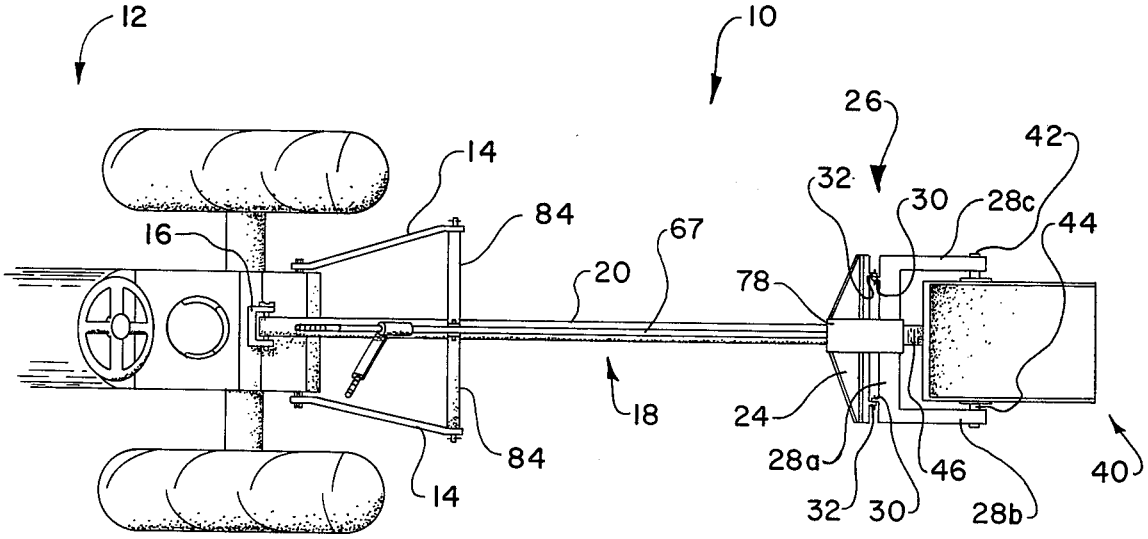
FIG. 2 is a plan view of the material handling device shown in FIG. 1.

With further reference to the drawings, particularly FIGS. 1 and 2, the material handling implement of the present invention is shown therein and indicated generally by the numeral 10. Material handling implement 10 is particularly adapted to be connected to and powered by the three-point hitch assembly of a conventional farm tractor, indicated generally by the numeral 12, the three-point hitch assembly including a pair of laterally spaced hydraulically actuated lower draft links 14 and an upper center hitch connection 16.

Viewing the material handling implement in detail, it is seen that the same comprises a main frame structure, indicated generally by the numeral 18, that extends generally rearwardly from tractor 12 when connected thereto. Main frame structure 18 includes a generally elongated beam 20 having an upper reenforcing tie member 22 extending thereabove. Formed about the rearmost end of beam 20 is a transverse support member 24 having a pair of laterally spaced leaf members 32 extending rearwardly therefrom.

Pivotably attached about the rearmost end of the main frame structure 18 is a scoop or shovel assembly, indicated generally by the numeral 26. Shovel assembly 26 basically includes a yoke 28 and a shovel, indicated generally by the numeral 40. Yoke 28 is basically U-shaped and includes a transverse base 28*a*, and a pair of arms 28*b* and 28*c* extending rearwardly from base 28*a*. Extending forwardly from the yoke base 28*a* is a pair of laterally spaced connecting leafs 30 that mate with corresponding connecting leafs 32 extending rearwardly from transverse member 24. Each set of mating leafs include openings bored transversely therethrough for receiving a pivot pin 34 that enables yoke 28 to be pivotably connected to the main frame structure 18.

The scoop or shovel 40 is pivotably mounted to the yoke 28 by incorporating a pair of transversely mounted stub shafts 42 and 44 which are secured about opposite sides 41 and 43 of scoop or shovel 40 and extend outwardly therefrom. The outer ends of stub shafts 42 and 44 are rotatively supported by the rearwardly extending arms 28*b* and 28*c* of the yoke 28. Also included within the scoop or shovel 40 is a cutting edge 40*a* which extends transversely across the rearmost end of scoop or shovel 40.

In addition a curved anchor plate 46 is secured about the frontmost end (or back side) of the scoop or shovel 40. Anchor plate 46 provides both a stop for the pivotably mounted shovel 40 and a catch means for receiving a locking pin to be described subsequently herein.

Shovel 40 is basically movable between a digging or filling position (FIG. 3) and a dumping position (dotted lines in FIG. 1). To facilitate movement of the shovel from the dumping position back to the digging position, the shovel 40 is counterbalanced such that it automatically returns from the dumping position to the digging position in response to the shovel 40 being emptied. This particular counterbalancing is attained by strategically positioning stub shafts 42 and 44 off-center and adding weight to the general back area of scoop or shovel 40. In order to obtain this automatic return feature by counterbalancing the shovel, it will be appreciated that various size and shaped shovels will require counterweighting in certain locations relative to the shovel's axis of rotation.

Figure 3:
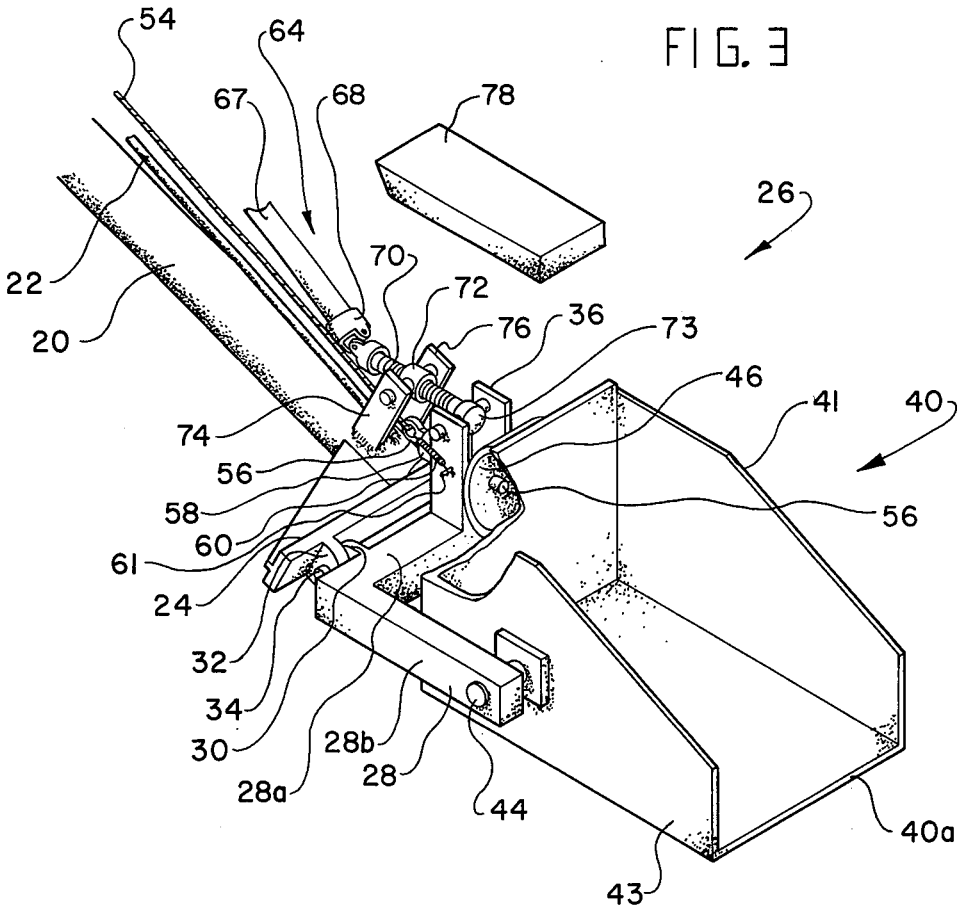
FIG. 3 is a fragmentary perspective view of the material handling implement of the present invention showing the scoop or shovel assembly and the adjacent end of the implement's main frame structure as viewed from the rear and to one side.
Figure 4:
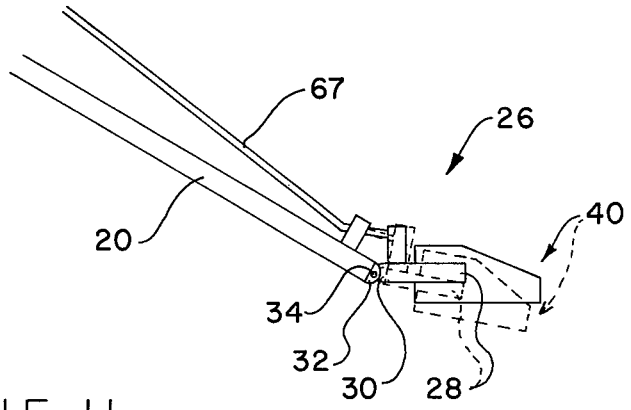
FIG. 4 is a diagrammatic side elevational view of the material handling implement of the present invention illustrating the digging angle adjustment capability of the scoop or shovel assembly.

Cooperatively associated with the scoop or shovel assembly 26 is a manually actuated dump mechanism indicated generally by the numeral 48. The manually actuated dump mechanism 48 includes hand lever 50 pivotably attached to post 52 which is positioned about the frontmost end of main frame structure 18 and adjacent to the operator's station of the tractor 12. Fastened to hand lever 50 and running longitudinally and rearwardly through cable guides 62 is cable 54. Located at the rearmost end of cable 54 and attached thereto is locking pin 56 which extends rearwardly through a sleeve 58. Sleeve 58 is longitudinally secured between vertical plates 36 and 38 and includes a rearmost end that terminates adjacent anchor plate 46 when shovel 40 is in the digging position. Locking pin 56 is axially movable within sleeve 58 and normally biased to a locking position within plate 46 by springs 60. In the locking position, locking pin 56 extends from the rearmost end of sleeve 56 and through an opening formed in anchor plate 46 as best illustrated in FIG. 3.

An additional feature of the material handling implement 10 is the provision of a manually actuated scoop angle adjustment mechansim, generally indicated by the numeral 64. The manually actuated scoop adjustment mechanism 64 includes a hand crank 66 that is rotatively supported by post 52 disposed about the frontmost end of main frame structure 18 and conveniently located such that the same can be rotatively actuated from the operator's station. The hand crank 66 is operative to rotate an extension shaft 67 integrally formed therewith and extending generally rearwardly therefrom, the extension shaft being connected to a helix or worm gear 70 via universal joint 68. Worm gear 70 is supported about its midpoint by a threaded collar 72 which is pivotably mounted about a transverse axis secured between laterally spaced plates 74 and 76 which are secured to the rearmost portion of the main frame structure 18 and extend vertically therefrom. The rearmost portion of helix or worm gear 70 is rotatively anchored in an end cap 73 disposed between the laterally spaced plates 36 and 38 at a point generally above the locking pin 56 and sleeve 58 so as to prevent longitudinal movement of the helix or worm gear 70 with respect to the scoop assembly 26 but yet allowing the helix or worm gear 70 to rotate within the end cap 73.

With respect mainly to FIG. 1, it can be observed that situated generally above the locking pin 56 and worm gear 70 is a cover plate 78 pivotably attached about the uppermost ends of vertically extending plates 36 and 38. Cover plate 78 is held snugly about the uppermost ends of plates 74 and 76 by a pair of cover retaining springs 77 (one not shown) attached between the cover plate 78 and spring retaining bar 61.

An alternate embodiment of the present invention could include the addition of material engaging teeth disposed across the cutting edge 40*a* of shovel 40. A further modification would be a shovel having increased capacity by extending the shovel width and providing a recessed yoke enclosure formed into the shovel 40.

A connecting frame assembly, indicated generally by the numeral 80, allows the material handling implement to be connected to the three-point hitch of the conventional farm tractor 12. Included within the connecting frame 80 are two generally vertically extending legs 82 and 84 disposed about opposite sides of the main frame structure 18, and pivotably attached at their lowermost ends to the two laterally spaced lower draft links 14. Legs 82 and 84 are pivotably attached at their uppermost ends to a selected adjustment opening 90 associated with and located within a height adjustment bar 88. Connecting frame 80 is structurally reenforced by cross member 86 which extends transversely between legs 82 and 84 and secured by weldment or other suitable means therebetween. By selectively attaching the uppermost end of the connecting frame 80 to any one of the adjustment openings 90 the user may vary the upper and lower travel limits of the material handling implement 10. This may particularly be useful with different size tractors. Finally hitching to the tractor's three-point hitch assembly is completed by pivotably attaching the forwardmost end of main frame structure 18 to the center hitch connection 16.

As pointed out heretofore, the material handling implement of the present invention has the capability to perform the following three-phase operation: (1) digging of selected material such as dirt, manure, etc., (2) transporting such material, and (3) dumping the same at desired times and locations. As illustrated in FIG. 1, the material handling implement 10 after having been attached to the three-point hitch of tractor 12 can be lowered into an aligned position with the material (not shown) which is to be shoveled. The operator at this time may adjust the angle of penetration of the shovel 40 relative to the main frame structure 18 in order to achieve a more effective cut into the particular material. This angle of penetration adjustment is performed by manually rotating the hand crank 66 either clockwise or counterclockwise with respect to the operator's station.

After this, the tractor 12 may be backed rearwardly, forcing the scoop or shovel 40 into the material. The operator, having filled the shovel with the material, now actuates the three-point hitch assembly which rotatively raises the material handling implement to a transporting position. Upon arrival at the desired dumping site, the operator so positions the scoop or shovel assembly 26 such that it is directly above the selected dump area. At this time the operator pulls the uppermost end of hand lever 50 frontwardly, thereby disengaging the locking pin 56 from the anchor plate 46. Shovel 40 is now free to rotate about its axis of rotation. The weight of the material contained therein causes the shovel 40 to rotate clockwise as viewed in FIG. 1. The dotted lines of FIG. 1 also illustrate the approximate configuration of the material handling implement 10 at the time the material is vacating the shovel interior. After dumping is completed, the shovel 40 rotates counterclockwise from the dumping position (dotted lines in FIG. 1) to the digging position (full lines in FIG. 1). Anchor plate 46 stops the abovementioned rotation of the shovel 40 by coming into contact with the rearmost portion of vertical plates 36 and 38. In addition, curved anchor plate 46 utilizes a camming action to force the locking pin 56, which is biased to its rearmost extension by springs 60, forward until the shovel is fully returned to the digging position, at which time the locking pin 56 reengages the hole located within the anchor plate 46. By being securely attached to the shovel 40, the anchor plate 46 provides a rigid support for the shovel 40 when it is in the digging position.

With further reference to FIG. 1, it may be observed by paying particular attention to the dotted lines that the material handling implement 10 of the present invention may be used to dump various materials into a larger material transporting vehicle such as a dump truck or the like. This operation is performed by elevating the material handling implement 10 to a position such that the scoop or shovel assembly 26 is generally above the material transporting vehicle's load bed. The dump operation mentioned heretofore is now performed. After several loads have been dumped into the load bed, the material transporting vehicle may transport the material out of the vicinity.

From the foregoing specification, it is apparent that the material handling implement of the present invention is particularly suited for light to medium duty material handling jobs that are likely to arise on small farms and in other similar situations. The material handling implement presented herein is compatible with a conventional farm tractor inasmuch as the same can be generally and easily connected and disconnected therefrom. Thus, it is appreciated that the material handling implement of the present invention is relatively inexpensive, easy to use, quite versatile, and very beneficial to the user thereof.

The terms "upper", "lower", "forward", "rearward", etc., have been used herein merely for the convenience of the foregoing specification and in the appended Claims to describe the material handling implement and its parts as oriented in the drawings. It is to be understood, however, that these terms are in no way limiting to the invention since the material handling implement may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A material handling implement adapted to be connected to and powered by a three-point hitch assembly of a conventional tractor, said material handling implement comprising:

a. a main frame structure including a single elongated beam member having front and rear ends;

b. connecting means operatively associated with said elongated beam member for connecting said beam member to the three-point hitch assembly of said tractor such that when connected to said tractor said elongated beam member extends generally rearwardly from said tractor and may be powered up and down by the tractor's three-point hitch assembly, said connecting means including means for directly pivotly connecting said front end of said beam member to an upper central hitch point of said three-point hitch assembly and a pair of connecting links connected to respective lower left links forming a part of said three-point hitch assembly and extending generally upwardly therefrom where they connect to elongated beams about an intermediate point between said front and rear ends thereof;

c. a transverse support member secured to the rearward end of said elongated beam member and including two laterally spaced apart leaf members projecting from said transverse support members;

d. a shovel assembly secured to said transverse support member disposed about the rear end of said elongated beam member;

e. said shovel assembly including a generally U-shaped yoke pivotably mounted to said leaf members projecting from said transverse support member, and a shovel pivotably mounted about a transverse axis within said U-shaped yoke and movable between a filling position and a dumping position;

f. said shovel including counter balancing means strategically associated with said shovel relative to said shovel's axis of rotation for causing said shovel to automatically return from said dumping position to said filling position in response to said shovel being emptied;

g. said shovel further including an anchor plate having a generally curved shaped caming surface with an opening therein with said anchor plate being secured about the rear side of said shovel and which generally abuts against shovel stop means forming a part of said shovel assembly when said shovel is disposed in said filling position;

h. shovel blocking means normally engaged with said shovel and operative to maintain said shovel in said filling position, said shovel locking means including a locking pin axially movable within a sleeve stationarily mounted to said shovel assembly with said locking pin being spring biased so as to normally extend through said opening formed in said anchor plate for locking said shovel in said filling position;

i. actuating means operatively connected to said shovel locking means for effectively disengaging said locking pin from said opening formed in said anchor plate such that said shovel may move from said filling position to said dumping position due to the presence of material within said shovel, said actuating means for disengaging said locking pin including a lever pivotably mounted about said elongated beam about a forward portion thereof in reach of an operator stationed on said tractor, and a cable operatively interconnected between said lever and said locking pin; and j. manually actuated control means associated with said material handling implement for adjusting and varying the angle of said shovel assembly relative to said elongated beam member such that the digging angle of said shovel may be adjusted for various working conditions, said manually actuated control means including a hand crank rotatively mounted about said elongated beam member and positioned thereon about the front area thereof in reach of the tractor operator and a worm gear rotatively mounted in a collar stationarily secured relative to said elongated beam member wherein said worm gear is operatively connected between said hand crank and said shovel assembly such that the actuation of said hand crank causes said shovel assembly and the shovel thereof to be angularly adjusted relative to said elongated beam member.

2. The material handling implement of claim 1 wherein said material handling implement includes a plurality of aligned openings formed about a ridge member extending longitudinally along said beam member, and wherein said pair of connecting links extending upwardly from said lower lift links of said three-point hitch assembly are provided with disconnectable connecting means so as to allow said connecting links to be secured about any of said aligned openings disposed longitudinally about the ridge of said elongated beam member, thereby providing for the angle adjustment of the elongated beam member with respect to the tractor when the three-point hitch assembly is maintained in a stationary position.

3. The material handling implement of claim 2 wherein said stop means comprises a first pair of laterally spaced upstanding post members secured to a rear transversely extending portion forming a part of said yoke and wherein said post members are aligned with said anchor plate to act on said stop means for stopping said shovel in said filling position; and wherein said worm gear is supported between said upstanding post members and wherein said collar for said worm gear is held between a second pair of upstanding post members fixed to and extending upwardly from said elongated beam member and aligned with said first two upstanding post members.

* * * * *